US010356850B2

(12) United States Patent
Mochizuki

(10) Patent No.: US 10,356,850 B2
(45) Date of Patent: Jul. 16, 2019

(54) HEATER PROTECTIVE TUBE FOR MOLTEN METAL HOLDING FURNACE

(71) Applicant: Tounetsu Co., Ltd, Fujinomiya-shi, Shizuoka (JP)

(72) Inventor: Kiyata Mochizuki, Fujinomiya (JP)

(73) Assignee: Tounetsu Co., Ltd, Shizuoka (JP)

( * ) Notice: Subject to any disclaimer, the term of this patent is extended or adjusted under 35 U.S.C. 154(b) by 0 days.

(21) Appl. No.: 15/541,084

(22) PCT Filed: Aug. 31, 2015

(86) PCT No.: PCT/JP2015/074616
§ 371 (c)(1),
(2) Date: Jun. 30, 2017

(87) PCT Pub. No.: WO2016/185625
PCT Pub. Date: Nov. 24, 2016

(65) Prior Publication Data

US 2018/0070410 A1 Mar. 8, 2018

(30) Foreign Application Priority Data

May 15, 2015 (JP) ..... 2015-100382

(51) Int. Cl.
*H05B 3/44* (2006.01)
*H05B 3/66* (2006.01)
(Continued)

(52) U.S. Cl.
CPC ..... *H05B 3/44* (2013.01); *B22D 41/01* (2013.01); *B22D 45/00* (2013.01); *F22B 3/08* (2013.01);
(Continued)

(58) Field of Classification Search
CPC ..... F27D 2099/0013; F27D 11/02; F27D 99/0006; H05B 3/44; H05B 3/66;
(Continued)

(56) References Cited

U.S. PATENT DOCUMENTS 1,416,897 A * 5/1922 Simon ..... H05B 3/78 219/523
1,651,861 A * 12/1927 Abbott ..... H05B 3/78 219/541
(Continued)

FOREIGN PATENT DOCUMENTS

JP H022933 B2 1/1990
JP H02-042755 U1 3/1990
(Continued)

OTHER PUBLICATIONS

International Search Report dated Dec. 1, 2015, from related Application No. PCT/JP2015/074615, 3 pages.
(Continued)

*Primary Examiner* — Steven S Anderson, II
(74) *Attorney, Agent, or Firm* — Meunier Carlin & Curfman LLC

(57) ABSTRACT

Provided is a heater protection tube for use with a molten metal holding furnace with heat dissipation and insulating properties. A heat protection tube 31 has a distal tapered cylindrical portion 35 corresponding to the inside tapered cylindrical portion 21 and a proximal non-tapered cylindrical portion 36 corresponding to the outside non-tapered cylindrical portion 22. The heater protection tube (31) is configured so that it can be mounted in the side wall (13) with the distal tapered cylindrical portion (35) located at the inside tapered cylindrical portion (21) and with the proximal non-tapered cylindrical portion (36) located at the outside non-tapered cylindrical portion (22).

5 Claims, 4 Drawing Sheets

(51) Int. Cl.

| | |
|---|---|
| ***H05B 3/82*** | (2006.01) |
| ***F27B 3/20*** | (2006.01) |
| ***F27D 99/00*** | (2010.01) |
| ***F27D 11/02*** | (2006.01) |
| ***F22B 3/08*** | (2006.01) |
| ***B22D 45/00*** | (2006.01) |
| ***B22D 41/01*** | (2006.01) |

(52) U.S. Cl.
CPC ..... *F27B 3/20* (2013.01); *F27D 11/02* (2013.01); *F27D 99/0006* (2013.01); *H05B 3/66* (2013.01); *H05B 3/82* (2013.01); *F27D 2099/0013* (2013.01)

(58) Field of Classification Search
CPC . H05B 3/78; H05B 3/82; F22B 37/105; F22B 3/08; F27B 3/20; B22D 45/00; B22D 41/01
See application file for complete search history.

(56) References Cited

U.S. PATENT DOCUMENTS

| | | | | |
|---|---|---|---|---|
| 2,159,414 | A | 5/1939 | Wilcox | |
| 3,688,007 | A | 8/1972 | McKenna | |
| 4,520,487 | A * | 5/1985 | Graniou | H05B 3/66 338/279 |
| 5,948,352 | A | 9/1999 | Vender Jagt | |
| 7,993,574 | B2 | 8/2011 | Wisdom | |
| 2010/0278208 | A1* | 11/2010 | Andersson | F27D 11/02 373/128 |
| 2010/0290766 | A1* | 11/2010 | Mochizuki | H05B 3/78 392/503 |

FOREIGN PATENT DOCUMENTS

| | | | |
|---|---|---|---|
| JP | 4-000198 | B2 | 1/1992 |
| JP | H09185983 | A | 7/1997 |
| JP | 2013170801 | A | 9/2013 |

OTHER PUBLICATIONS

English Translation of International Preliminary Report on Patenability dated Nov. 16, 2017, from International Application No. PCT/JP2015/074616, 12 pages. es.

English Translation of International Preliminary Report on Patenability dated Nov. 16, 2017, from International Application No. PCT/JP2015/074615, 11 pages.

International Search Report dated Dec. 1, 2015, from related Application No. PCT/JP2015/074616, 2 pages.

Non-Final Office Action, dated Mar. 19, 2019, in connection with U.S. Appl. No. 15/541,079.

* cited by examiner

HEATER PROTECTIVE TUBE FOR MOLTEN METAL HOLDING FURNACE

TECHNICAL FIELD

The present invention relates to a heater protection tube for use with a molten metal holding furnace for holding a molten metal.

BACKGROUND ART

Conventionally, there has been disclosed a molten metal holding furnace for holding a molten metal of aluminum in patent document 1. The molten metal holding furnace disclosed in Patent Document 1 has a furnace body for holding a molten metal. The furnace body has a side wall formed with a hole through which a heating tube is inserted into the molten metal.

Another heating tube which is available for the molten metal holding furnace is disclosed in patent document 2.

PRIOR ART DOCUMENTS

Patent Documents

Patent Document 1: JP 2013-170801 A

Patent Document 2: JP 5371784 B

Each of the molten metal holding furnaces disclosed in patent documents 1 and 2 uses the transversely immersed heating tube to heat the molten metal through natural convection, which is advantageous in that the molten metal is not excessively heated and, therefore, the oxidation of the molten metal in this furnace is reduced than in another molten metal holding furnace in which the surface of the molten surface is heated.

For an aluminum molten metal holding furnace, a temperature of the molten metal is controlled to, for example, 700 degrees Celsius which is slightly higher than the aluminum melting temperature, i.e., 660 degrees Celsius. The solidification temperature of aluminum is about 550 degrees C. Therefore, the temperature of a proximal end portion of the heating tube (i.e., a portion located outside a furnace wall) is controlled to 550 degrees Celsius or less, preventing the molten aluminum from leaking through cracks possibly generated in the material filled around the heating tube.

If the temperature of the proximal end portion of the heating tube were lowered to a temperature far less than 550 degrees Celsius, an amount of heat released from the proximal end portion of the heating tube increases, which is disadvantageous in terms of thermal efficiency.

The heating tube disclosed in patent document 2 has an inwardly tapered proximal end portion supported by the furnace wall. The side wall of the molten metal holding furnace using the heating tube has an associated tapered through-hole in which the corresponding tapered portion of the heating tube is wedgedly fitted. This results in that the material filled between the heating tube and the through-hole is tightly retained due to the wedge-effect, effectively preventing the leakage of the molten metal. The tapered member of patent document 2 is outwardly and inversely tapered and the maximum cross section of the taper is located at the outermost end of the wall thereof. This arrangement is advantageous in terms of heat radiation, but it might be disadvantageous in terms of heat retention.

SUMMARY OF THE INVENTION

It is therefore an object of the present invention to provide a new heating tube protection tube for use with a molten metal holding furnace having appropriate heat dissipation and retention properties.

For this purpose, a heater protection tube for use with a molten metal holding furnace, the molten metal holding furnace comprising a furnace body (11) including a bottom wall (12), a ceiling wall, and a side wall (13) extending between the bottom wall (12) and the ceiling wall to form a molten metal containing space (18) defined by the bottom wall (12), the ceiling wall, and the side wall (13), the furnace body (11) including at least one insertion hole (20) formed to extend through the side wall (13) or the ceiling wall; and a heater protection tube (31) including a heat generator (51) and inserted in the insertion hole (20), the molten metal holding furnace (10) for holding a molten metal contained in the molten metal containing space (18) at a predetermined temperature by using heat generated by the heat generator (51), wherein the heater protection tube (31) includes a distal tapered cylindrical portion (35) corresponding to an inside tapered cylindrical portion (21) and a proximal non-tapered cylindrical portion (36) corresponding to an outside non-tapered cylindrical portion (22), and the heater protection tube (31) is configured so that it can be mounted in the side wall (13) with the distal tapered cylindrical portion (35) located at the inside tapered cylindrical portion (21) and with the proximal non-tapered cylindrical portion (36) located at the outside non-tapered cylindrical portion (22).

According to another embodiment of the present invention, the heater protection tube (31) has a stepped portion (37) formed of an annular surface extending radially between the distal tapered cylindrical portion (35) and the non-tapered proximal cylindrical portion (36) of the heating tube (30).

According to another embodiment of the present invention, the distal tapered cylindrical portion (35) and the proximal non-tapered cylindrical portion (36) of the heater protection tube (31) is made of a single material.

According to another embodiment of the present invention, the distal tapered cylindrical portion (35) and the proximal non-tapered cylindrical portion (36) of the heat protection tube (31) are formed of different members, and the tapered distal cylindrical portion (35) and the proximal non-tapered cylindrical portion (36) are connected by heat.

According to another embodiment of the present invention, the distal tapered cylindrical portion (35) of the heat protection tube (31) has an outer diameter continuously increasing from inside to outside of the furnace.

According to another embodiment of the present invention, the inside cylindrical portion (21) of the insertion hole (20) has an inner diameter discontinuously increasing from inside to outside of the furnace.

According to another embodiment of the present invention, at least one of the distal tapered cylindrical portion (35) and the proximal non-tapered cylindrical portion (36) of the heater protection tube (31) has convex or concave portions extending continuously or discontinuously in a peripheral direction of the heater protection tube (31).

According to the heater protection tube (31) so constructed, the heat of the molten metal moves through the heat protection tube (31) in a direction from the distal end (inside of the furnace) toward the proximal end (outside of the furnace). Because the cross-sectional area is significantly reduced at the boundary between the distal tapered cylindrical portion (35) and the proximal non-tapered cylindrical portion (36), the heat transmitted beyond the boundary from the distal cylindrical portion (35) to the proximal cylindrical portion (36) is limited so that the proximal cylindrical portion (36) is maintained at a considerably low temperature. Therefore, a molten metal moving from the inside of the furnace to the outside of the furnace along the outer circumferential surface of the heater protection tube (31) is solidifies on the way and does not flow out of the furnace. An amount of heat which would be dissipated to the atmosphere is significantly reduced. Therefore, the molten metal holding furnace with an enhanced heat dissipation and retention properties is provided.

PREFERRED EMBODIMENTS OF THE INVENTION

A molten metal holding furnace of one embodiment according to the present invention will now be described with reference to the accompanying drawings. In the description of the molten metal holding furnace, portions thereof located inside and outside the furnace are indicated by accompanying positional languages "inside" and "outside", respectively. In the description of a heating tube inserted through a furnace wall of the molten metal holding furnace, portions of the heating tube located inside and outside the furnace are indicated by accompanying positional languages such as "distal" and "proximal," respectively.

Figure 1:
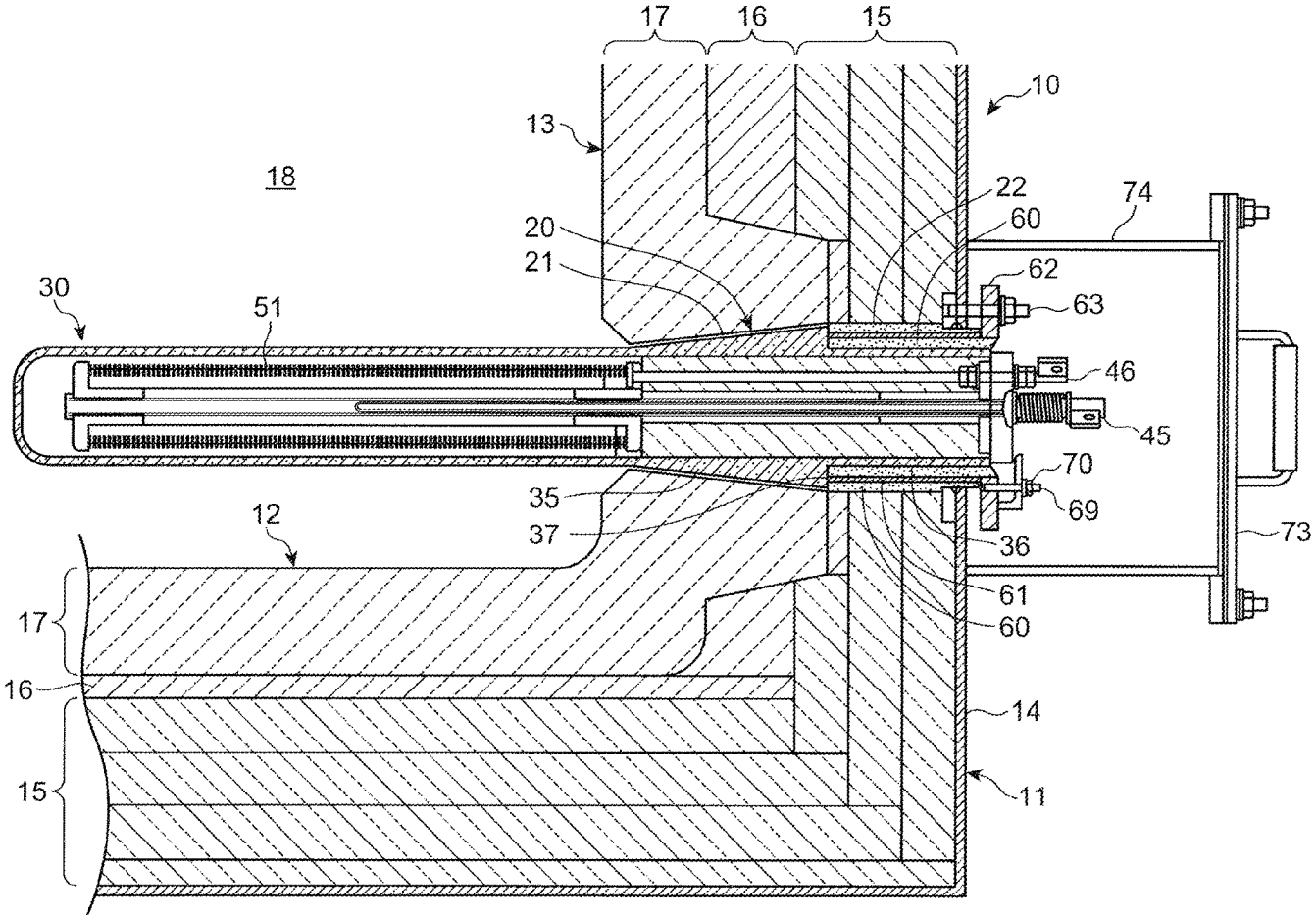
FIG. 1 is a partial cross-sectional view of a molten metal holding furnace according to a first embodiment of the present invention.

FIG. 1 is a cross-sectional view of a portion of a molten metal holding furnace 10 for holding a molten metal such as aluminum. The furnace 10 includes a furnace body 11. Similar to the conventional molten metal holding furnace, the furnace body 11 is made up of a bottom wall 12 and a peripheral or side wall 13 extending upwardly from the periphery of the bottom wall 12. Typically, the bottom wall 12 and the side wall 13 include an iron-made outer wall (iron shell) 14, a heat insulating layer 15, a backup layer 16, and a fireproof layer 17 positioned in this order from outside to inside thereof, and a molten metal holding chamber 18 is formed inside the fireproof layer 17.

Figure 2:
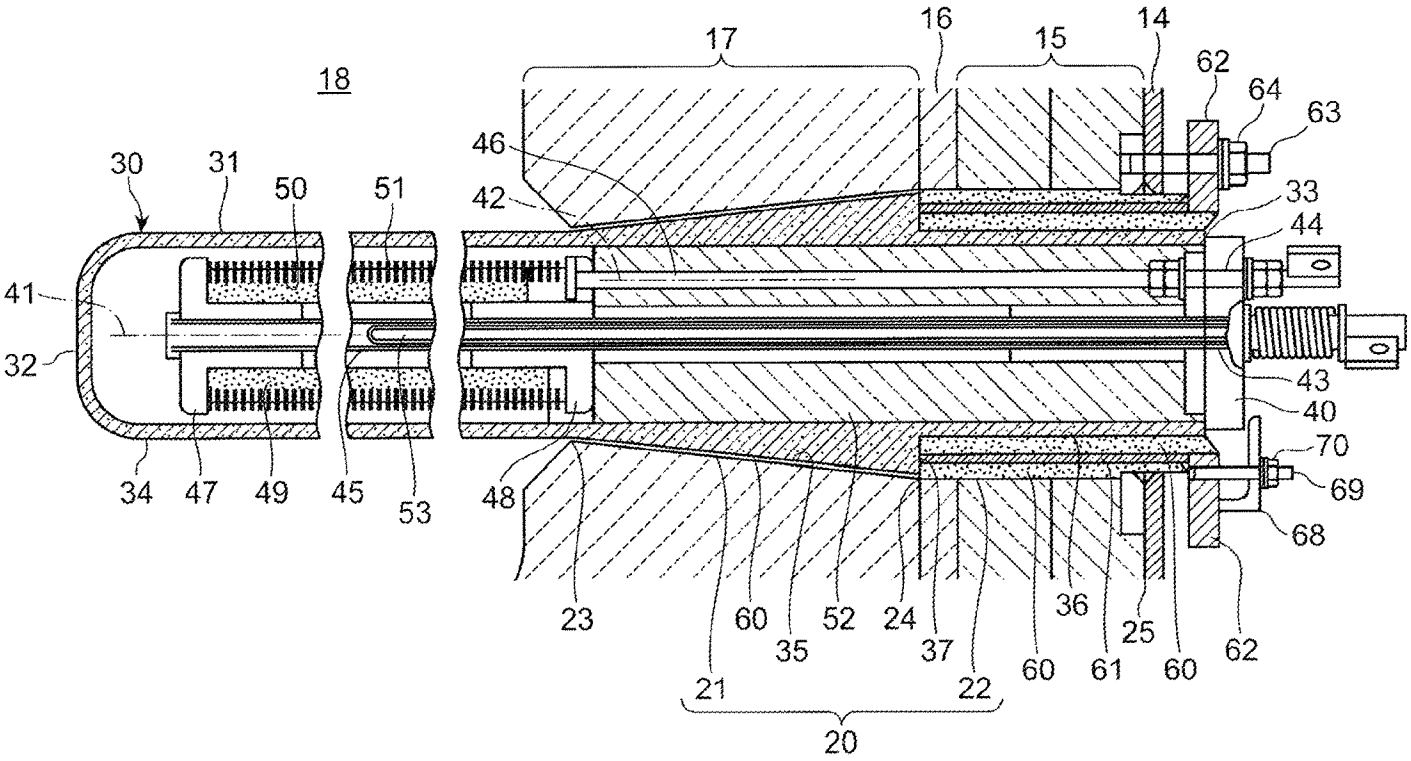
FIG. 2 is a cross-sectional view of a heating tube used in the molten metal holding furnace shown in FIG. 1.

As shown in FIG. 2, the side wall 13 of the molten metal holding furnace 10 has a plurality of horizontally-oriented tube-insertion holes (hereinafter referred to as "tube insertion holes") 20 formed adjacent the bottom wall 12 for supporting heating tubes described later. As shown in the drawing, each of the tube insertion holes 20 has an inside cylindrical portion (tapered cylindrical portion) 21 and an outside cylindrical portion (non-tapered cylindrical portion) 22. The inside cylindrical portion 21 extends from a starting point (innermost end) indicated by reference numeral 23 to an intermediate point indicated by reference numeral 24 and has a cylindrical tapered surface gradually tapering from outside to inside. The outer cylindrical portion 22 extends from the intermediate point 24 to a terminal point (outermost end) indicated by reference numeral 25 and has a cylindrical non-tapered surface having an inner diameter that is the same as the outermost end inner diameter of the inner cylindrical portion 21.

In the region surrounding the periphery of the tube insertion hole 20, the inside fireproof layer 17 of the furnace body 11 is larger in thickness than the outside heat insulating layer 15. The inside cylindrical portion 21 is formed in the fireproof layer 17 and the outside cylindrical portion 22 is formed in the backup layer 16 and the heat insulating layer 15.

The heating tube 30 has a heater protection tube 31. The heater protection tube 31, which is made of silicon nitride-based ceramic, for example, has a substantially cylindrical shape with a closed distal end portion 32 protruding into the molten metal holding chamber 18 and an opened proximal end portion 33 protruding from the side wall 13.

An inner surface of the heater protection tube 31 is defined by a cylindrical surface having a constant diameter and extending entirely from the proximal end portion 33 to the distal end portion 32. An outer surface of the heater protection tube 31 has a constant diameter cylindrical surface portion 34, a tapered cylindrical surface portion (distal cylindrical surface portion) 35, and a constant diameter non-tapered cylindrical surface portion (proximal cylindrical surface portion) 36. When the heater protection tube 31 is inserted in the tube insertion hole 20, the constant diameter cylindrical surface portion 34 is positioned in the molten metal holding chamber 18 and the distal and proximal cylindrical surface portions 35 and 36 are positioned in the vicinities of the fireproof and insulating layers 17 and 15, respectively. The taper angle of the distal cylindrical portion 35 is the same as that of the inside cylindrical portion 21 of the tube insertion hole 20. As shown in the drawings, the proximal cylindrical portion 36 of the heater protection tube 31 has a diameter smaller than that of the outside cylindrical portion 22 of the tube insertion hole 20. A stepped portion 37 is formed of an annular surface extending radially from the distal end of the proximal cylindrical portion 36 toward the proximal end of the distal cylindrical portion 35.

A proximal end opening of the heater protection tube 31 is closed by an end plate 40. The end plate 40 has a first electrode insertion hole 43 extending along a central axis 41 of the heater protection tube 44 and a second electrode insertion hole 44 which extends parallel to the central axis 41 and is radially displaced away from the central axis 41. Electrode bars (terminals) 45 and 46 are inserted through the first and second electrode insertion holes 43, 44 into the interior of the heater protection tube 31.

As shown in the drawings, the first electrode bar 45 disposed on the central axis 41 is extended through the end plate 40 to terminate in the vicinity of the distal end of the heater protection tube 31, and the second electrode bar 46 disposed on the axis 42 away from the central axis 41 is extended through the end plate 40 to terminate in the vicinity of the distal end (the starting point 23) of the distal cylindrical portion 35 of the heater protection tube 31. The proximal ends of the first electrode bar 45 and the second electrode bar 46 are projected outside of the end plate 40.

Two annular or tubular insulating heat-resistant supporting members 47 and 48 are fixed on distal portions of the first electrode bar 45, located in the molten metal holding chamber 18 and spaced apart from each other in the axial direction, to position the first electrode bar 45 on or in the vicinity of the central axis 41. The proximal heat resisting supporting member 48 supports the distal end of the second electrode bar 46. The heat-resistant supporting members 47 and 48 support a hollow insulating heat-resistant cylindrical body 49 externally mounted on the first electrode bar 45 around the central axis 41. Helical grooves 50 are formed on an outer circumferential surface of the heat-resistant cylindrical body 49 mounted on the first electrode bar 45, and a heat generator (electric heater) 51 is fitted in the grooves 50. The heat generator 51 is electrically connected at opposite ends thereof to the first and second electrode bars 45 and 46.

As shown in the drawings, preferably, a heat insulating material 52 is disposed inside a portion of the heater protection tube 31, positioned between the proximal end plate 40 and the proximal heat-resistant supporting member 48.

As shown in the drawings, the first electrode bar 45 may be made of a hollow cylindrical tube to accommodate a thermocouple 53 therein.

The heating tube 30 so constructed, in particular the heater protection tube 31 in which the electrode bar or the heat insulating material has not been assembled is inserted from outside into the tube insertion hole 20 in the side wall 13. Before the insertion of the heater protection tube 31, a filling material 60 of a cement paste or a mortar cement is applied on one or both of the tapered surface (the inside cylindrical portion 21) of the tube insertion hole 20 and the distal cylindrical surface 35 of the heating tube 30 which would be brought into contact with the tapered surface. The heater protection tube 31 is then inserted in the tube insertion hole 20. In this process, the tapered surface (the distal cylindrical portion) 35 of the heater protection tube 31 is fitted into the corresponding tapered surface (the inside cylindrical portion) 21 of the tube insertion hole 20 and thereby indisplaceably fixed in a precise manner. Because the tapered surface (the distal cylindrical portion) 35 of the heater protection tube 31 is wedgedly fitted on the tapered surface (the inside cylindrical portion) 21 of the tube insertion hole 20, the filling material 60 held between the tapered surfaces extends evenly between the tapered surfaces to form a filling material layer having a constant thickness around the heater protection tube 31.

A tubular member 61 may be coaxially and externally mounted on the proximal cylindrical portion 36 of the heating tube 30. In this embodiment, the tubular member 61 is a cylindrical body made of a heat conductive material (e.g., metal such as stainless steel) and the distal end thereof is brought into contact with the stepped portion 37. Therefore, in this embodiment, the tubular member 61 functions as a heat dissipating member. The tubular member 61 may be mounted on the proximal cylindrical portion 36 of the heater protection tube 31 before inserting the heater protection tube 31 into the tube insertion hole 20 or may be mounted on the proximal cylindrical portion 36 of the heater protection tube 31 after inserting the heater protection tube 31 into the tube insertion hole 20. In either case, the filling material 60 such as a cement paste or a cement mortar is filled in an annular gap formed between the outside cylindrical portion 22 of the tube insertion hole 20 and the tubular member 61 and an annular gap between the proximal cylindrical portion 36 of the heating tube 30 and the tubular member 61.

An annular fixing member 62 is disposed on the proximal end of the tubular member 61. The tubular member 61 and the fixing member 62 may be different members or may be integrally connected with each other into a single member. The fixing member 62 is tightened to the outer wall 14 facing thereto by a suitable fastening means (fastener) such that the tightened force can be adjusted. For example, the fastening means has bolt insertion holes (not shown) formed in the outer wall 14 and the fixing member 62 at predetermined intervals in the circumferential direction, bolts 63 inserted through these bolt insertion holes, and nuts 64 externally mounted on the bolts 63. In this embodiment, the distal end of the tubular member 61 is pressed against the stepped portion 37 of the heater protection tube 31 by tightening the nuts 64, which results in that the heater protection tube 31 is firmly fixed in the tube insertion hole 20.

Subsequently, an assembly made by combining the electrode bars 45 and 46, the heat-resistant supporting members 47 and 48, the insulating heat-resistant cylindrical body 49, the heat generator 51, the heat insulating material 52, the thermocouple 53, and the end plate 40 is inserted inside the heater protection tube 31.

Finally, metal fittings (angle members) 68 are arranged outside the fixing member 62 at regular intervals in the circumferential direction around the central axis 41. Then, bolts 69 are inserted through screw holes (not shown) formed in the fixing member 62 and also holes (not shown) formed in the metal fittings. Lastly, nuts 70 are tightened on the bolts to fix the end plate 40 to the fixing member 62 and the furnace body 11.

The proximal ends of the first and second electrode bars 45, 46 are connected to a power source.

As shown in the figures, preferably, a tubular frame 74 having an opening/closing plate 73 is fixed to the outer wall 14 around the electrode bars 45, 46, the end plate 40, and the fixing member 62 to prevent the electrode bar 45, 46 from being exposed.

According to the molten metal holding furnace 10 so constructed, an electric power is supplied through the electrode bars 45 and 46 to heat the heat generator 51. Using the heat from the heat generator 51, the molten metal in the molten metal holding furnace 10 is maintained at a predetermined melting temperature.

The influence of heat transmitted from the heat generator 51 to the heater protection tube 31 and the heat transmitted from the molten metal may cause cracks in the filling material 60 filled around the heater protection tube 31 over time, allowing the molten metal to advance along the cracks from the inside toward the outside. According to the present invention, the filling material 60 filled between the distal cylindrical portion (tapered surface) 35 of the heater protection tube 31 and the inside cylindrical portion (tapered surface) 21 of the tube insertion hole 20 is evenly filled with the aid of pressing force applied from the outside toward the inside, i.e., a force applied from the tubular member 61 on the stepped portion 37 of the heater protection tube 31 by tightening of the bolts 63. This minimizes the occurrence of the crack and. Also, even if occurred, the cracks are so small. In addition, an amount of heat moving from the distal end toward the proximal end of the heater protection tube 31, in particular, the amount of heat capable of moving from the distal cylindrical portion 35 to the reduced diameter proximal cylindrical portion 36 is reduced significantly at the boundary of the distal and proximal cylindrical portions 35 and 36 and, therefore, the resultant heat reaching the proximal end of the proximal cylindrical portion 36 is considerably small, which in turn means that only a small amount of heat is discharged into the atmosphere.

In this embodiment, the heat in the distal cylindrical portion 35 is transmitted through the proximal cylindrical portion 36 adjacent thereto and also through the tubular member 61 in contact with the proximal end stepped portion 37 of the distal cylindrical portion 35 into the atmosphere. Therefore, when designing the aluminum molten metal furnace, for example, cross sections of the distal and proximal cylindrical portions 35 and 36 and the tubular member 61 and also a cross section ratio between the proximal and distal cylindrical portions 36 and 61 (i.e., heat dissipation and heat insulation properties) are determined to compromise the heat dissipation and insulation to maintain the temperature of the stepped portion 37 at about 550 Celsius.

Figure 3:
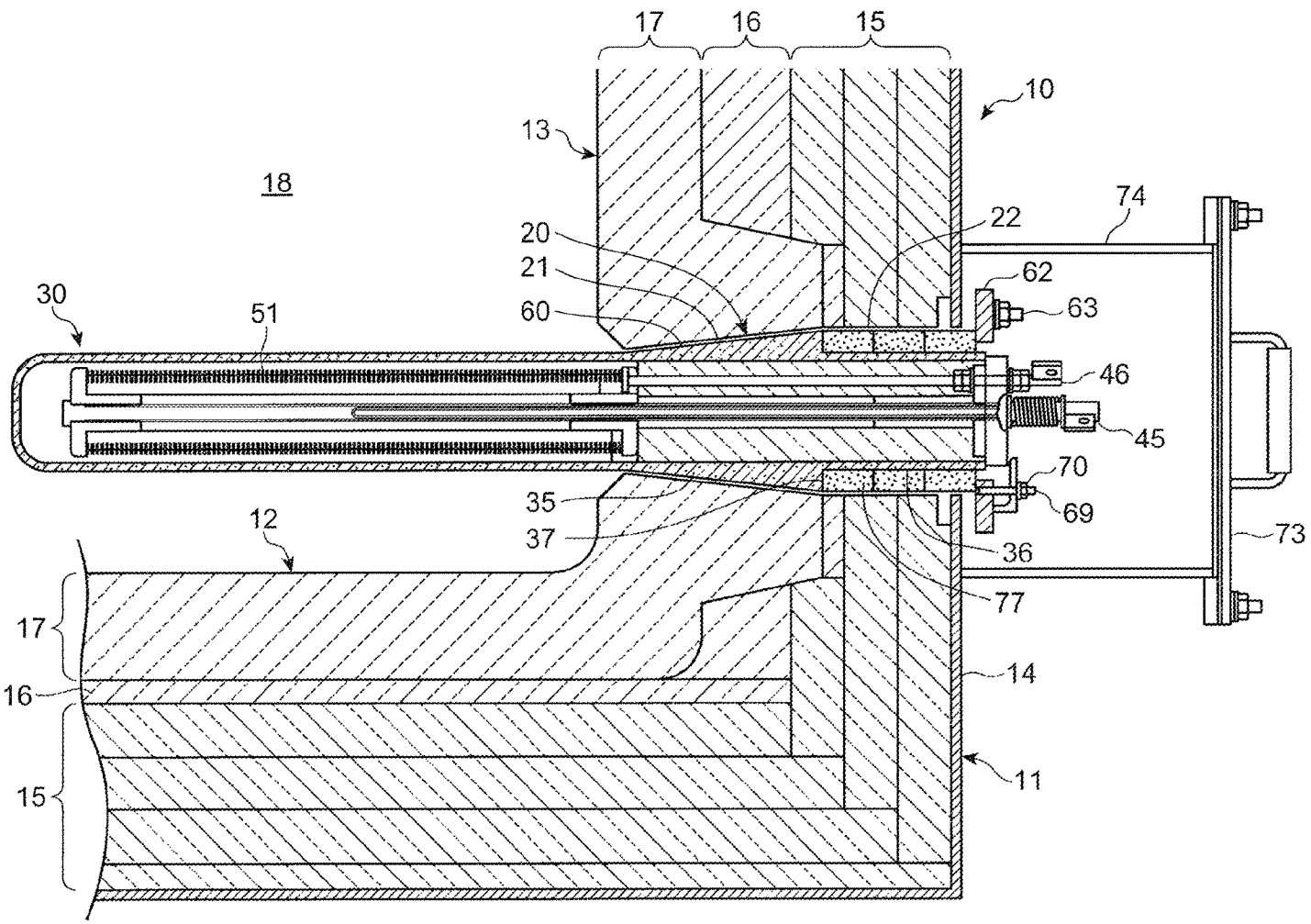
FIG. 3 is a partial cross-sectional view of a molten metal holding furnace according to another embodiment.

The present invention is not limited to the embodiments described above and may be modified in various ways. For example, although in the embodiment described above the heat dissipating tubular member 61 is provided around the proximal cylindrical portion 36 of the heater protection tube 31 to release a portion of the heat through the tubular member 61 to the atmosphere, as shown in FIG. 3 the proximal cylindrical portion 36 of the heater protection tube 31 may be covered with a tubular member (heat insulating member) 77 made of a heat insulating material. In this embodiment, the fixing member 62 is disposed on the proximal of the tubular member 77, and the tubular member 77 is forced against the stepped portion 37 of the heater protection tube 31 through the fixing member 62 by the fastening means described above.

The metal-made tubular member 61 has a thermal expansion coefficient larger than those of the surrounding heat insulating and backup layers 15 and 16, allowing the tubular member 61 to force the stepped portion 37 strongly and thereby to prevent the leakage of the molten metal effectively. Also, even in operation of the molten metal holding furnace, the tubular member 61 may be replaced by another member made from different material or with different shape for controlling the heat dissipation and insulation properties of the furnace.

In this embodiment, the distal cylindrical portion 36 may have a thickness larger than that of the previous embodiment in order to ensure a suitable heat dissipation property. In this instance, preferably the cross section of the distal and proximal cylindrical portions 35 and 36 of the heater protection tube 31 is determined so that the temperature at the stepped portion 37 is controlled to be about 550 degrees Celsius.

Although in either of the two embodiments described above the proximal cylindrical portion 36 of the heater protection tube 31 has a fixed outer diameter, it may be an inwardly or outwardly tapered cylindrical portion of which outer diameter decreases gradually in a direction from outside to inside or from inside to outside.

Figure 4:
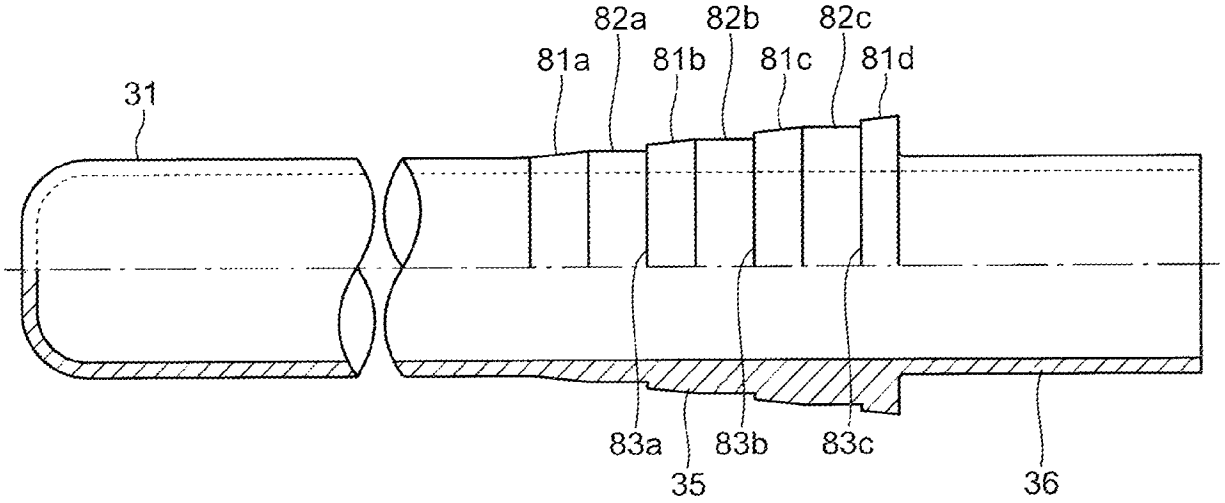
FIG. 4 is a partial cross-sectional view of a heater protection tube according to another embodiment.

As shown in FIG. 4, the tapered surface of the distal cylindrical portion 35 of the heater protection tube 31 may be formed of a pseudo-tapered surface in which tapered cylindrical surfaces 81*a*-81*d* and non-tapered cylindrical surfaces 82*a*-82*c* are arranged alternately. In this embodiment, preferably the outer diameters of the non-tapered cylindrical surfaces 82*a*-82*c* are designed to be smaller than the respective outer diameter of the proximally adjacent tapered cylindrical surfaces 81*b*-81*d* to form annular steps 83*a*-83*c* at boundaries therebetween. Likewise, an annular stepped portion may be formed between the tapered cylindrical surface and the proximally adjacent non-tapered cylindrical surface. With the arrangement, the filling material 60 between the distal cylindrical portion 35 of the heater protection tube 31 and the opposing inner cylindrical portion 21 of the tube insertion hole 20 is forced in the axial direction, which ensures that the filling material is more evenly filled therebetween without filling defect. Further, corresponding to the tapered surface of the distal cylindrical portion of the heater protection tube 31, the inner cylindrical portion of the tube insertion hole 20 may be formed of a correspond pseudo-tapered surface as described above.

Although in the previous embodiment the distal cylindrical portion 35 of the heater protection tube 31 is formed integrally with the heater protection tube 31, it may be made by combining a non-tapered tube having a constant outer diameter and a tapered tube securely mounted on the outer periphery of the non-tapered tube. Those tubes may be made of the same or different materials.

Also, although in the previous embodiment the proximal cylindrical portion 36 of the heater protection tube 31 is formed integrally with the distal cylindrical portion 35, they may be connected by heat. Those tubes may be made of the same or different materials.

Further, in the previous embodiments, either the distal cylindrical portion 35 or the proximal cylindrical portion 36 or both may have annular or helical convex portions (grooves) or concave portions (projections) formed on the peripheral surfaces thereof. The convex or concave portions may extend in a continuous or discontinuous manner in the peripheral direction.

Although in the above descriptions the tube insertion tube 20 is provided in the side wall 13, it may be formed in a ceiling wall through which the heating tube is vertically inserted. A molten metal holding furnace including the vertical heating tube is also included in the technical scope of the present invention.

PARTS LIST

10: molten metal holding furnace
11: furnace body
12: bottom wall
13: side wall
14: outer wall (iron shell)
15: heat insulating layer
16: backup layer
17: fireproof layer
18: molten metal containing space
20: tube insertion hole
21: inside cylindrical portion (tapered surface)
22: outside cylindrical portion (cylindrical surface)
23: starting point
24: intermediate point
25: terminal point
30: heating tube
31: heater protection tube
32: distal end portion
33: proximal end portion
34: cylindrical surface
35: distal cylindrical portion (tapered surface)
36: proximal cylindrical portion (cylindrical surface)
37: stepped portion
40: end plate
41: central axis
42: axis (offset axis)
43: first electrode insertion hole
44: second electrode insertion hole
45: first electrode bar
46: second electrode bar
47, 48: heat-resistant supporting member
49: insulating heat-resistant cylindrical body
50: groove
51: heat generator (heater)
52: heat insulating material
53: thermocouple

60: filling material
61: tubular member (heat dissipating material)
62: fixing member
63: bolt
64: nut
68: metal fitting
69: bolt
70: nut
73: opening/closing plate
74: frame
77: tubular member (heat insulating material)
80: pseudo-tapered surface
81: tapered cylindrical surface
82: non-tapered cylindrical surface

The invention claimed is:

1. A molten metal holding furnace, the molten metal holding furnace comprising:

a furnace body including a bottom wall, a ceiling wall, and a side wall extending between the bottom wall and the ceiling wall to form a molten metal containing space defined by the bottom wall, the ceiling wall, and the side wall, the furnace body including at least one insertion hole formed to extend through the side wall or the ceiling wall, the at least one insertion hole having an inside tapered cylindrical portion and an outside non-tapered cylindrical portion, wherein the inside tapered cylindrical portion is closer than the outside non-tapered cylindrical portion to the molten metal containing space; and a heater protection tube including a heat generator, the heater protection tube being inserted in the at least one insertion hole, wherein the heat generator generates heat for holding a molten metal contained in the molten metal containing space at a predetermined temperature, wherein the heater protection tube includes a distal tapered cylindrical portion and a proximal non-tapered cylindrical portion, the distal tapered cylindrical portion corresponding to the inside tapered cylindrical portion and the proximal non-tapered cylindrical portion corresponding to the outside non-tapered cylindrical portion, the heater protection tube is configured so that it can be mounted in the side wall with the distal tapered cylindrical portion located at the inside tapered cylindrical portion and with the proximal non-tapered cylindrical portion located at the outside non-tapered cylindrical portion, and wherein the distal tapered cylindrical portion of the heater protection tube has a discontinuously tapering outer diameter such that the outer diameter increases from inside to outside of the furnace.

2. The molten metal holding furnace according to claim 1, wherein the heater protection tube further comprises a stepped portion forming an annular surface extending radially between the distal tapered cylindrical portion and the non-tapered proximal cylindrical portion.

3. The molten metal holding furnace of claim 1, wherein the distal tapered cylindrical portion and the proximal non-tapered cylindrical portion of the heater protection tube are both made of a single material.

4. The molten metal holding furnace according to claim 1, wherein the distal tapered cylindrical portion and the proximal non-tapered cylindrical portion of the heat protection tube are thermally connected but formed of different materials such that heat to be transferred from the distal tapered cylindrical portion to the proximal non-tapered cylindrical portion of the heat protection tube is reduced at a boundary of the distal tapered cylindrical portion and the proximal non-tapered cylindrical portion of the heat protection tube.

5. The molten metal holding furnace according to claim 1, wherein at least one of the distal tapered cylindrical portion and the proximal non-tapered cylindrical portion of the heater protection tube has convex or concave portions extending continuously or discontinuously in a peripheral direction of the heater protection tube.

* * * * *